United States Patent [19]

Bock

[11] 4,240,554

[45] Dec. 23, 1980

[54] NESTABLE CONTAINER

[75] Inventor: Erik Bock, Kirke Hyllinge, Denmark

[73] Assignee: Superfos Emballage A/S, Vipperød, Denmark

[21] Appl. No.: 65,088

[22] Filed: Aug. 9, 1979

[30] Foreign Application Priority Data

Aug. 24, 1978 [DK] Denmark ..... 3735/78

[51] Int. Cl.³ ..... B65D 21/02

[52] U.S. Cl. ..... 206/519; 206/515; 220/72; 220/91; 220/353

[58] Field of Search ..... 206/515, 519, 520; 220/72, 91, 353

[56] References Cited

U.S. PATENT DOCUMENTS

| | | | |
|---|---|---|---|
| 1,620,059 | 3/1927 | Betts | 206/519 |
| 3,516,571 | 6/1970 | Roper | 220/72 |
| 3,550,807 | 12/1970 | Yates | 220/91 |
| 3,964,605 | 6/1976 | Vezirian | 220/353 |
| 4,161,248 | 7/1979 | Kalamanovitch | 220/353 |

*Primary Examiner*—George E. Lowrance
*Attorney, Agent, or Firm*—Bucknam and Archer

[57] ABSTRACT

An open container which is nestable with an underlying similar container and which is provided with wedge members and one or more locking members. Each locking member on the overlying container, in response to a relative rotation of the two nested containers, will engage and ride upon a guide surface of a corresponding wedge member of the underlying container until such locking member comes into engagement with an abutment surface of such wedge member, to secure the containers in a relative angular position established thereby. Subsequent similar containers may be stacked, nested one in another, and in a similar manner, be secured in a common angular orientation.

6 Claims, 4 Drawing Figures

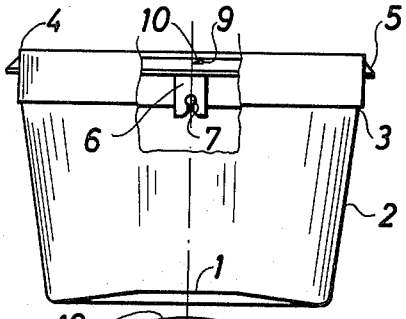
Fig.1
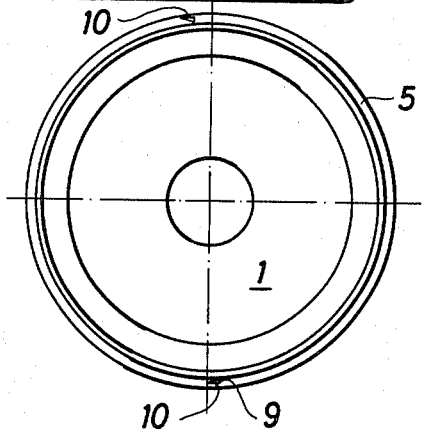
Fig.2
Fig.3
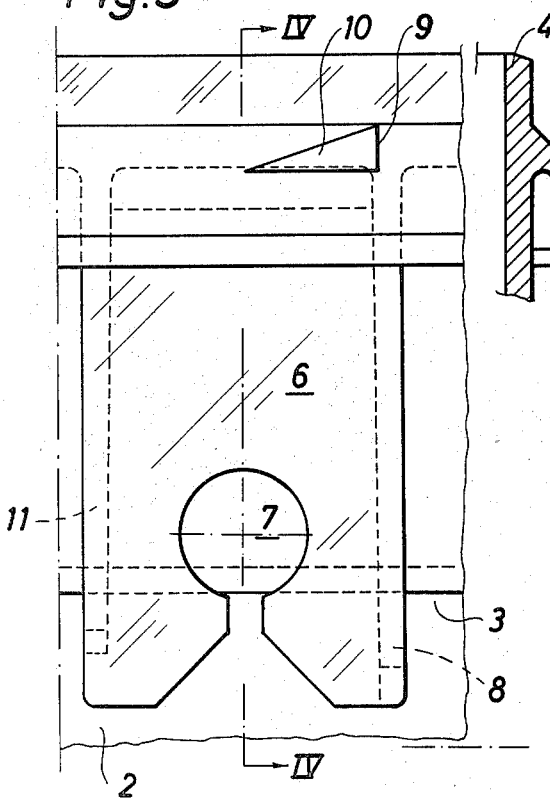
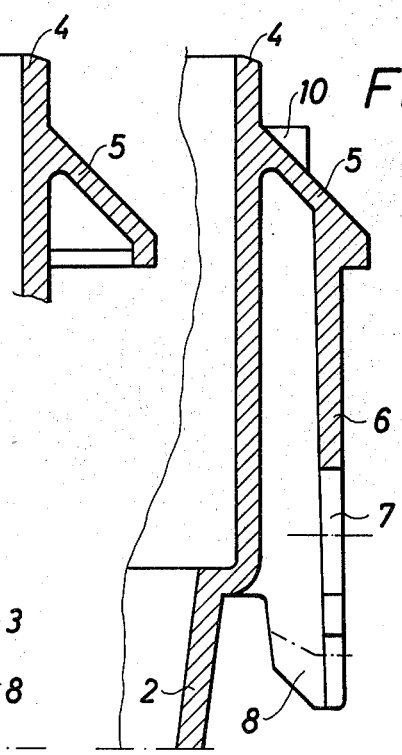
Fig.4

NESTABLE CONTAINER

The invention relates to a pot comprising a slightly conical side wall and means preventing said pot and an identically formed pot from being wedged in when they are piled inside each other.

For pots or pails capable of being piled inside each other it is of importance that the pots can be uniformly oriented in the pile, e.g. when the pile is to pass a separating apparatus separating the pots, or when the pots are to follow filling lines and be provided with imprints and handles. The mutual orienting of the pots may be performed by providing said pots with interior, co-operating projections. Pots having a completely smooth bottom and inner wall are, however, often desired, inter alia for production reasons and in order to permit stirring of the contents of the pot without difficulties.

According to the present invention a pot of the above type is provided, which comprises a smooth bottom and inner wall, but which nevertheless is formed in such a manner that it may be correctly oriented in a pile.

The pot according to the invention is characterized in that two clamping blocks are provided adjacent the mouth rim of the pot and comprise substantially radial, vertical locking surfaces turning in opposite peripheral directions relative to the pot, and a locking flap projecting radially from the side wall below the locking surfaces in such a manner that it may abut the locking surfaces of a pot situated below in a pile, whereby the end of each clamping block turning away from the locking surface forms such a guidance that it may carry the lower end of the locking flap across the clamping block and into engagement with the vertical locking surface when the pots are turned relative to each other.

The clamping blocks and the locking flaps co-operating therewith permit an easy orientation of a pot added at the top of a pile by rotating said pot for instance when it leaves the caster. Hereby the lower end of the locking flap passes across one of the clamping blocks and engages by a snap action the locking surface. Although a single locking flap can be maintained between two closely arranged locking surfaces opposing each other, the pot is, however, in practice usually provided with two locking flaps implying that the pot never has to be rotated more than 180° before it is locked in its oriented position.

An embodiment of the pot according to the invention which comprises two diametrically opposite locking flaps is characterized in that the vertical locking surfaces are arranged with a mutual angular distance equal to or somewhat larger than 180° plus the wall thickness of the locking flap. The clamping blocks arranged in such a manner co-operate with their respective locking flaps, and the clearance in the connection is sufficient for ensuring that the snap locking can take place, though the uppermost pot is only rotated by a slight power and the snapping in is simply implied by its weight.

In pots provided with two diametrically opposite ears or flaps for receiving the curved ends on a handle, said ears or flaps may be utilized for locking the pots in a pile in a correctly oriented position. This is the case for an embodiment of the pot according to the invention, in which the locking flap on opposite sides of the pot and a supporting wall as well as a handle flap substantially parallel to the side wall of the pot together confine a cavity for receiving a curved end of a handle extending through a recess in the handle flap, said pot being characterized in that said supporting wall comprises such a recess or is of such a length that at mutual rotation of two pots piled inside each other it can pass freely across the clamping block of the lower pot. The supporting wall may be shaped in such a manner that it assists in guiding the pot during rotation, since it may slide freely on a circumferential flange on the outside of the pot for instance together with the lower end of the locking flap. The clamping blocks according to the invention may in a simple manner be shaped as ramp-like projections or projections formed like the frustum of a pyramide on the reinforcing flange.

The means preventing the pots from being mutually wedged in in a pile is according to the invention preferably a circumferential shoulder, which furthermore forms part of the control of the rotation of the pot during the orientation.

The invention will be described below with reference to the accompanying drawing illustrating an embodiment of a pot according to the invention, whereby the locking flaps for orienting the pots are radial walls or ribs, which together with an additional supporting wall lock a handle flap having a recess, in which the curved end of a handle may be introduced.

The drawing illustrates

FIG. 1 a side view of the pot, partly in section,

FIG. 2 a top view of the pot of FIG. 1,

FIG. 3 on a larger scale, a side, sectional view of the pot, partly in section, and FIG. 4 a sectional view along the line IV—IV of FIG. 3.

The pot illustrated in the drawing comprises a bottom 1 and a conical side wall 2 permitting piling of the pot inside a corresponding pot having an outer shoulder 3. The shoulder rests on the mouth rim 4 of the lower pot. A short distance under the mouth rim the pot furthermore comprises a reinforcing flange 5 inclining downwards. The underside of this flange is shaped as two diametrically opposite handle flaps 6 extending substantially parallel to the side wall of the pot. These handle flaps comprise their respective recess 7 for receiving the curved end of a handle.

The handle flaps 6 are at their lateral edges supported by radial ribs or walls extending beyond the shoulder 3. One of these supporting walls forms a locking flap 8, which at rotation of the pot may abut a vertical locking surface 9 on a clamping block 10 of a pot situated below in the pile and projecting from the reinforcing flange 5. The handle flap 6 is at its opposite side connected to the side wall 2 of the pot through a radial supporting wall 11. This supporting wall is at its lower end cut stepwise in such a manner that the supporting wall 11 may pass freely across the clamping block 10.

The two clamping blocks 10 illustrated in FIG. 2 and comprising locking surfaces 9 turning in opposite peripheral directions are situated on their respective side of a diametrical plane through the pot, whereby they may co-operate with a locking flap 8 forming a supporting rib for a handle flap 6. The locking surface on the uppermost clamping block 10 of FIG. 2 is slightly more distanced from the diametrical plane than the locking surface of the lowest clamping block 10, whereby their mutual angular distance is slightly greater than 180° plus the wall thickness of the locking flap.

When a pot is piled inside the pot of FIG. 2 and turned counter-clockwise, the lowest clamping block 10 illustrated in FIG. 2 carries the corresponding locking flap 8 on the uppermost pot across the clamping block, whereby said locking flap engages its locking surface at the very moment that the uppermost clamping block 10 and its locking surface 9 illustrated in the Figure stop the corresponding locking flap on the uppermost pot. Then the pots are unpivotally secured relative to each other.

The above locking illustrated in connection with FIG. 2 of the pots occurs whether they are only provided with a single locking flap for the sake of the orientation or said locking flap forms part as a supporting rib for the handle flap 6, cf. the embodiment illustrated in FIGS. 1, 3, and 4. By rotating the uppermost pot counter-clockwise the locking flap of the uppermost pot is lifted and carried across the uppermost clamping block 10 illustrated in the Figure, and the locking flap 9 on the lowest clamping block forms a stop for the corresponding locking flap.

The pot may also be provided with two clamping blocks opposing each other on the same side of the pot and with a mutual distance only slightly greater than the thickness of the locking flap, but a better centering and a more reliable locking is obtained by employing clamping blocks on both sides of the pot. The shoulder portion 3 also assists in guidance during rotation of the pot towards the locking position. The clamping blocks 10 may conveniently be situated on the top side of the flange 5, although the blocks may also be situated directly on the side wall 2 of the pot.

From FIGS. 1–4 of the drawing, the artisan will appreciate that the invention provides a container of the type having a peripheral wall 2 and a generally circular upper rim 4 thereof defining an open container with a configuration disposed to receive a similar container (not shown) in releasable nested engagement therewith. To secure a stack of such containers nested together each in a given angular orientation, the invention provides an improvement comprising a pair of wedge members 10 on the container and adjacent to the upper rim 4, and at least one locking member 8. As better seen from FIG. 4, the wedge members 10 have each an abutment surface 9 extending outwardly with respect to the wall 2 of the container and a guide surface inclined with respect to the abutment surface 9. Each locking member 8 is connected to the wall 2 and extends outwardly therefrom. Each locking member 8 is positioned in relation to the wedge members 10 such that when one container is in nested engagement with another similar underlying container, the locking member 8 on the one container, in response to a relative rotation of the two containers, will engage and ride upon the guide surface of a corresponding wedge member 10 of the underlying container until said locking member comes into engagement with the abutment surface 9 of such wedge member 10 to secure the containers in a relative angular position established by such locking member 8 or members 8 and wedge members 10.

According to a preferred embodiment of the invention, there are provided a pair of the locking members 8 each connected to the wall 2 of the container, and disposed generally in diametrically opposed relation to each other. As better seen from FIG. 2, the pair of wedge members 10 are disposed in a corresponding diametrically opposed relation so as to engage each at the abutment surface 9 thereof, a corresponding locking member 8 of an overlying nested similar container (not shown).

FIGS. 3 and 4 exemplify a certain feature of the preferred embodiment of the invention whereby a plurality of wall members 6, 11 and a wall member opposite thereto which bears locking member 8, define a pair of compartments each connected to the wall 2 of the container and having a recess 7 disposed to receive the end portion of a bail (not shown). At the top of such compartments and connected to the wall 6 thereof is a circumferential outwardly extending flange 5 that is connected to the wall 2 of the container below the upper rim 4 thereof, and the wedge members 10 are each connected to the flange 5 for support thereby.

Other and further variations of the invention should become apparent to the artisan from the foregoing disclosure and accompanying drawing exemplifying a preferred embodiment.

I claim:

1. In a container of the type having a peripheral wall and a generally circular upper rim thereof defining an open container with a configuration disposed to receive a similar container in releaseable nested engagement therewith, the improvement which comprises a pair of wedge members on the container and adjacent said upper rim, said wedge members having each an abutment surface extending outwardly with respect to said wall and a guide surface inclined with respect to said abutment surface; and at least one locking member connected to said wall and extending outwardly therefrom, said locking member being positioned in relation to said wedge members such that when one container is in nested engagement with another similar underlying container, the locking member on said one container, in response to a relative rotation of said containers, will engage and ride upon the guide surface of a corresponding wedge member of the underlying container until said locking member comes into engagement with the abutment surface of such wedge member to secure said containers in a relative angular position established thereby.

2. The improvement according to claim 1 including a pair of said locking members connected to the wall of the container and disposed generally in diametrically opposed relation to each other, and wherein said pair of wedge members are disposed in a corresponding diametrically opposed relation to engage each at the abutment surface thereof a corresponding locking member of an overlying nested similar container.

3. The improvement according to claim 1 including a pair of said locking members, and a plurality of wall members defining a pair of compartments each connected to the wall of said container having a recess disposed to receive the end portion of a bail, each locking member being an extended portion of a respective one of the wall members defining a corresponding compartment.

4. The improvement according to claim 1 including a circumferential outwardly extending flange connected to the wall of said container, and wherein said wedge members are each connected to said flange for support thereby.

5. The improvement according to claim 1 wherein the peripheral wall of the container has a circumferential shoulder located below said upper rim, said shoulder being disposed to engage the upper rim of a similar underlying container when said containers are in nested engagement.

6. The improvement according to claim 5 wherein said locking member extends below and outwardly beyond said circumferential shoulder, and including a circumferential outwardly extending flange connected to the wall of said container above said shoulder, said wedge members each being connected to said flange for support thereby.

* * * * *